US012600559B2

(12) United States Patent
Cheng

(10) Patent No.: US 12,600,559 B2
(45) Date of Patent: Apr. 14, 2026

(54) CONTAINER WITH FIRE-RESISTANT, EXPLOSION-WITHSTANDING, AND HEAT-INSULATING CAPABILITIES

(71) Applicant: Jung-Cheng Cheng, New Taipei City (TW)

(72) Inventor: Jung-Cheng Cheng, New Taipei City (TW)

( * ) Notice: Subject to any disclaimer, the term of this patent is extended or adjusted under 35 U.S.C. 154(b) by 116 days.

(21) Appl. No.: 18/808,106

(22) Filed: Aug. 19, 2024

(65) Prior Publication Data

US 2025/0282540 A1 Sep. 11, 2025

(30) Foreign Application Priority Data

Mar. 5, 2024 (TW) ..... 113202184

(51) Int. Cl.

| | |
|---|---|
| ***B65D 88/12*** | (2006.01) |
| ***B65D 81/38*** | (2006.01) |
| ***B65D 90/00*** | (2006.01) |
| ***B65D 90/02*** | (2019.01) |
| ***F42B 39/14*** | (2006.01) |

(52) U.S. Cl.

CPC ..... *B65D 88/12* (2013.01); *B65D 81/3823* (2013.01); *B65D 90/008* (2013.01); *B65D 90/02* (2013.01); *F42B 39/14* (2013.01)

(58) Field of Classification Search

CPC ..... F42B 39/14; F42B 39/18; F42B 39/26; F42B 39/30; B65D 90/22; B65D 90/023; B65D 90/008; B65D 88/121; B65D 88/12

USPC ..... 220/660

See application file for complete search history.

(56) References Cited

U.S. PATENT DOCUMENTS

| | | | | |
|---|---|---|---|---|
| 9,248,958 | B2 * | 2/2016 | Pherson | B32B 27/42 |
| 10,589,919 | B2 * | 3/2020 | Losco | B65D 90/06 |
| 2004/0045847 | A1 * | 3/2004 | Fairbank | B65D 90/02 206/386 |
| 2011/0091713 | A1 * | 4/2011 | Miller | E04B 1/942 428/312.2 |

* cited by examiner

*Primary Examiner* — Anthony D Stashick
*Assistant Examiner* — Raven Collins
(74) *Attorney, Agent, or Firm* — Leong C. Lei

(57) ABSTRACT

The container includes at least a composite fireproof and explosion-proof plate assembly, at least a reinforcing steel bar, at least a heat-insulating fireproof layer, at least an external panel, at least a supporting steel bar, and multiple structural steel bars. The plate assembly is assembled with the reinforcing steel bar on its exterior. The heat-insulating fireproof layer is filled between the plate assembly and the external panel. The assembly of the external panel and the supporting steel bars is fixed to the multiple structural steel bars, forming a fireproof and explosion-proof energy storage container structure. This structure achieves the safety protection functions of fireproofing and explosion-proofing, effectively blocking and reducing the heat conduction of the container, providing excellent insulation, energy storage benefits, and reducing the internal temperature of the container.

9 Claims, 4 Drawing Sheets

CONTAINER WITH FIRE-RESISTANT, EXPLOSION-WITHSTANDING, AND HEAT-INSULATING CAPABILITIES

BACKGROUND OF THE INVENTION

(a) Technical Field of the Invention

The present invention generally relates to containers, and more particularly to a container with fire-resistant, explosion-withstanding, and heat-insulating capabilities.

(b) Description of the Prior Art

A container is a standardized steel case characterized by uniform dimensions. It is designed for the safe placement of cargo and can be stacked in layers. This stacking capability allows for the mass storage of containers on transoceanic container ships, providing cost-effective bulk transportation for various items, and facilitating the transportation of goods to their destinations.

A conventional container consists of a frame structure, a bottom structure with C-shaped structural steel bars, external steel plates, and movable door panels. While the conventional containers offer the convenience of loading and transporting various items, they also have the following drawbacks: (1) Lack of fireproof and explosion-proof functions, making them insufficiently safe for transporting hazardous or valuable goods; (2) The steel structures of the containers lack heat insulation, causing external heat to be quickly conducted to the internal items, leading to quality degradation and instability during transportation.

Therefore, effectively improving the fireproof and explosion-proof capabilities of conventional containers, enhancing the safety of loading and transporting valuable items, and improving the heat insulation to prevent heat conduction between the container's interior and the external environment are crucial issues to containers.

The creator of this project has thoroughly considered and broken through traditional thinking to propose a fireproof and explosion-proof energy storage container structure. This design uses composite fireproof and explosion-proof steel plates, reinforced square structural steel bars, and filled insulation fireproof layers, integrated with conventional container structures. The result is a container with enhanced fireproof and explosion-proof protection, effectively reducing heat conduction, providing energy storage, and lowering the internal temperature and the risk of fire and explosion.

SUMMARY OF THE INVENTION

A major objective of the present invention is to use the composite fireproof and explosion-proof plate assembly and the external panel, with a heat-insulating fireproof layer filled in between, to effectively block and reduce the heat conduction of the container. This provides energy storage benefits, reduces the internal temperature of the container, and enhances the stability of items loaded and transported.

Another objective of the present invention is to use the assembly of reinforcing steel bars in conjunction with the composite fireproof and explosion-proof plate assembly to further strengthen the container structure. This achieves the safety protection functions of fireproofing and explosion-proofing, thereby enhancing the safety of loading and transporting items.

To achieve these objectives, a novel container is disclosed, which contains at least a composite fireproof and explosion-proof plate assembly, at least a reinforcing steel bar, at least a heat-insulating fireproof layer, at least an external panel, at least a supporting steel bar, and multiple structural steel bars. The at least one composite fireproof and explosion-proof plate assembly is assembled with the at least one reinforcing steel bar on its exterior. The heat-insulating fireproof layer is filled between the at least one composite fireproof and explosion-proof plate assembly and the external panel. The assembly of the at least one external panel and the supporting steel bars is fixed to the multiple structural steel bars, forming a fireproof and explosion-proof energy storage container structure. This invention utilizes the composite fireproof and explosion-proof plate assembly, assembled with reinforcing steel bars, and filled with a heat-insulating fireproof layer, integrating with the container structure. It achieves the safety protection functions of fireproofing and explosion-proofing, effectively blocking and reducing the heat conduction of the container, providing excellent insulation, energy storage benefits, and reducing the internal temperature of the container.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
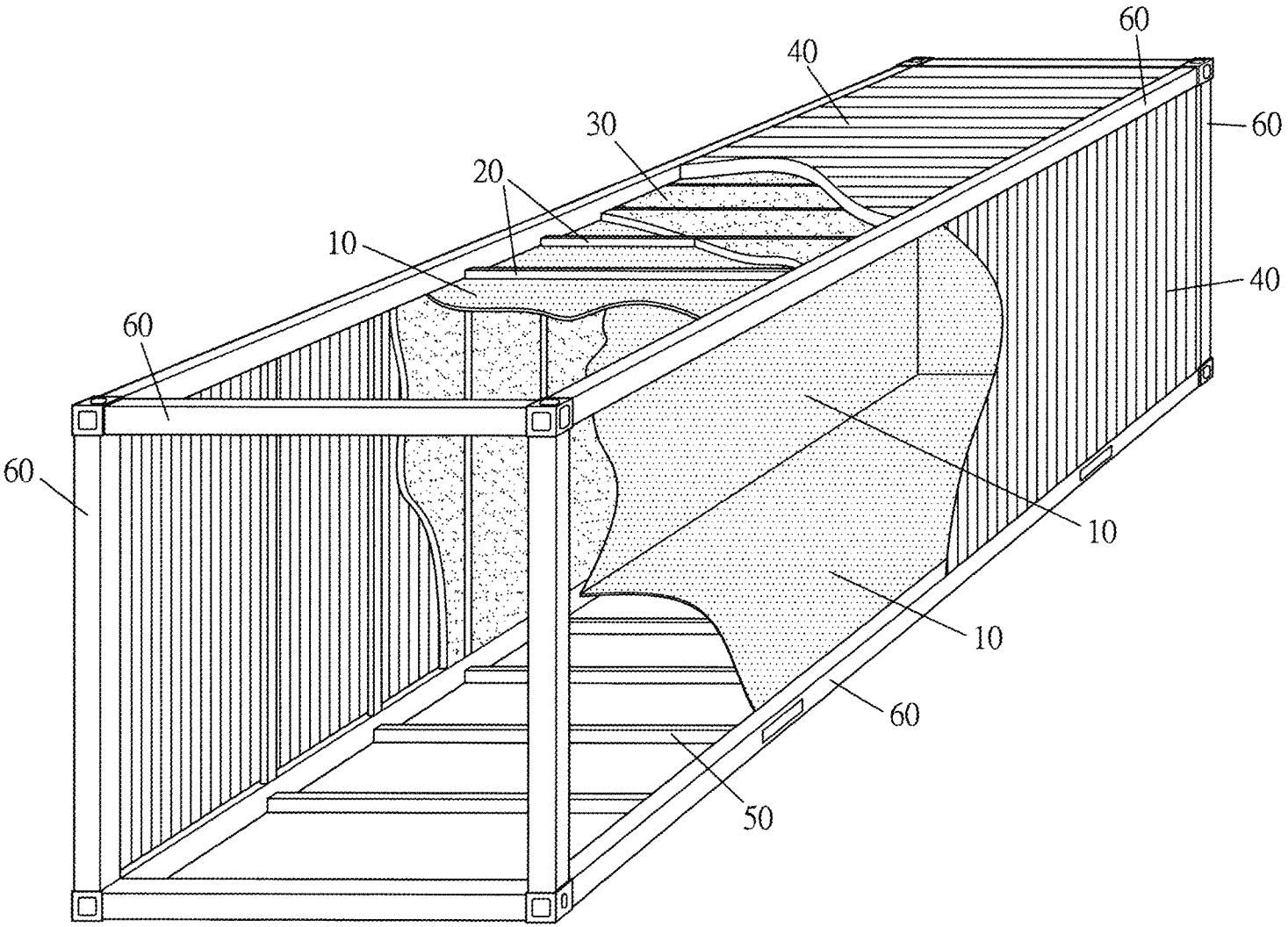
FIG. 1 is a perspective diagram showing a container according to an embodiment of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 5, a container according to an embodiment of the present invention includes:

multiple structural steel bars 60 end-to-end connected as the edges of a rectangular structure;

at least one composite fireproof and explosion-proof plate assembly 10, which is composed of at least two coated and perforated steel plates 11, and at least one reinforced fiberboard 12 fixedly sandwiched in between;

at least one cross-sectionally square-shaped reinforcing steel bar 20, which is spaced on the outer side of the plate assembly 10 whose two ends are respectively connected to two parallel structural steel bars 60;

at least one external panel 40, which is assembled between structural steel bars 60;

at least one heat-insulating fireproof layer 30, which is installed between two adjacent reinforcing steel bars 20, and is located between the plate assembly 10 and the external panel 40; and at least one cross-sectionally C-shaped supporting steel bar 50, whose two ends are respectively connected two parallel structural steel bars 60 forming the bottom side of the rectangular structure, and is laid beneath a plate assembly 10.

A container with fire-resistant, explosion-withstanding, and heat-insulating capabilities is formed by assembling the above-described components.

In the present embodiment, the coated and perforated steel plate 11 of the plate assembly 10 is a galvanized perforated steel plate.

Figure 5:
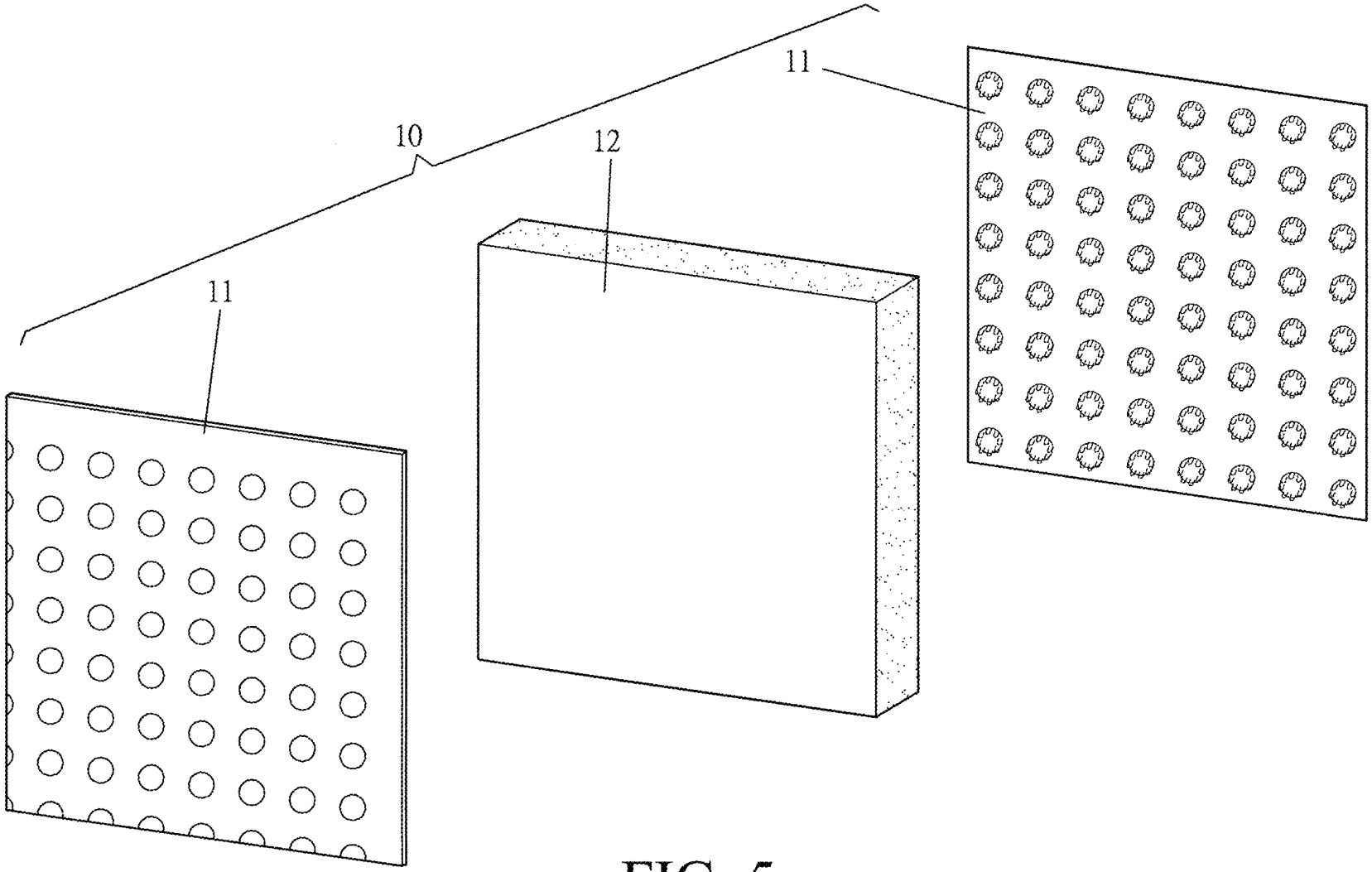
FIG. 5 is a perspective break-down diagram showing a plate assembly of the container of FIG. 1.

As shown in FIG. 5, the perforations in the coated and perforated steel plate 11 are sawtooth-shaped circular perforations.

The reinforced fiberboard 12 of the plate assembly 10 is a reinforced fiber cement board.

Figure 2:
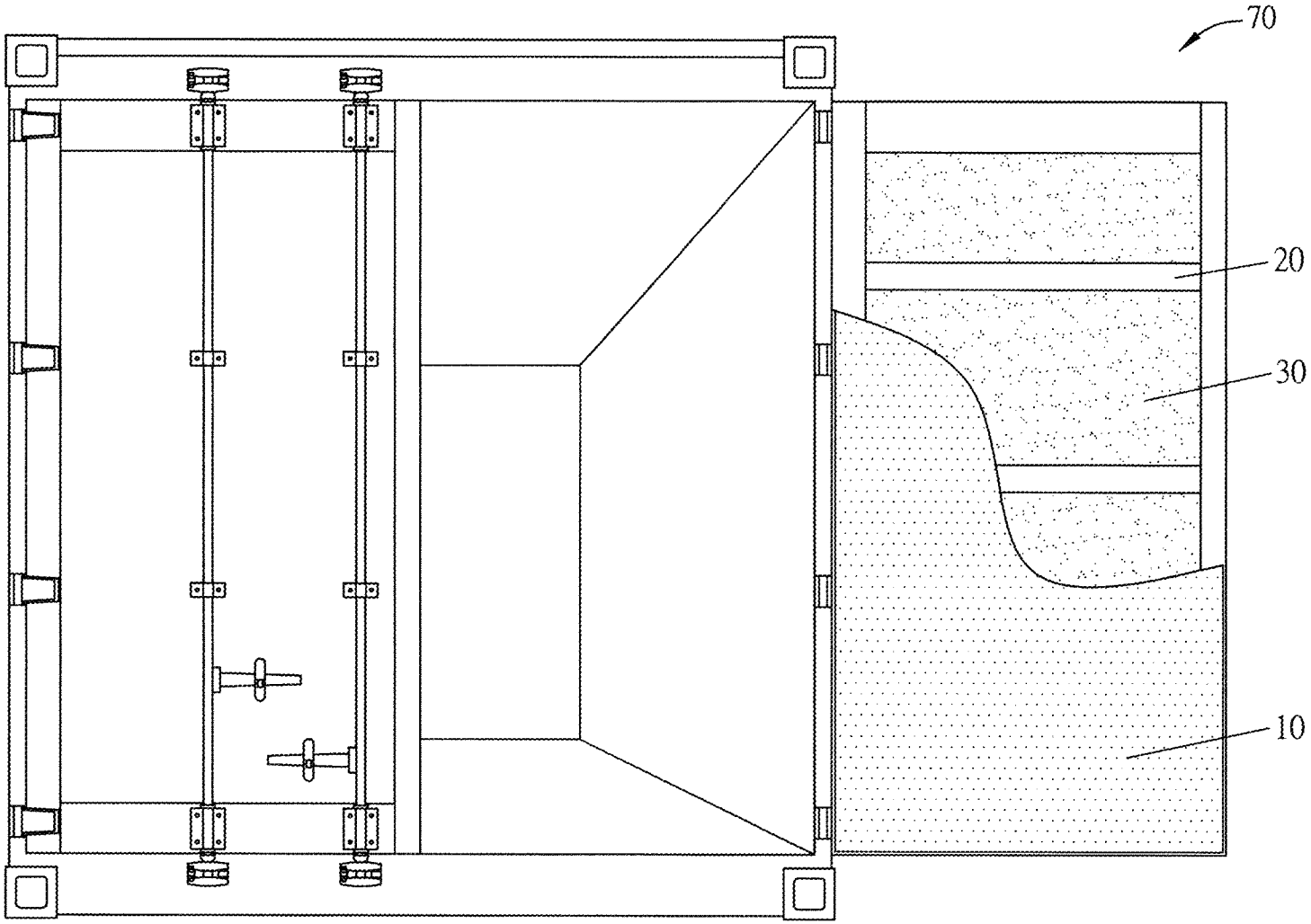
FIG. 2 is a front-view diagram showing the container of FIG. 1.
Figure 3:
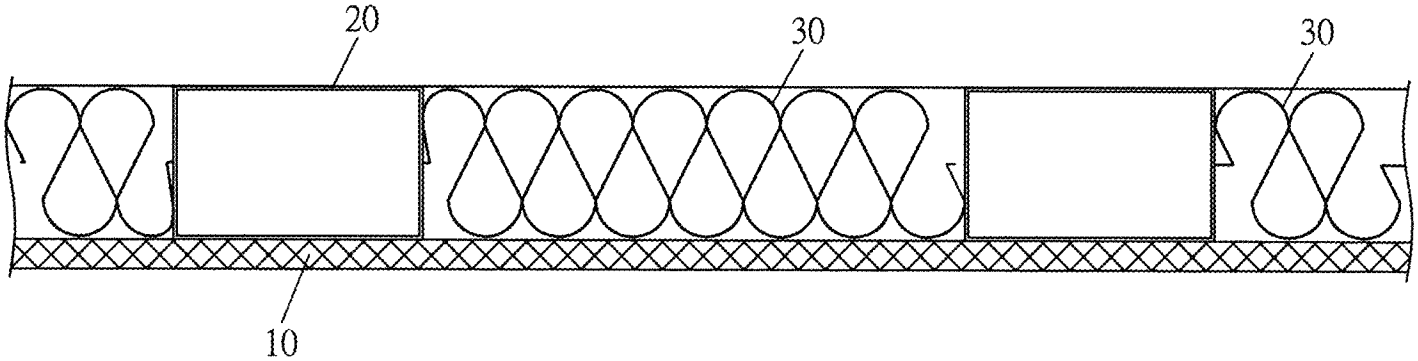
FIG. 3 is a sectional diagram showing a plate assembly, reinforcing steel bars, and heat-insulating fireproof layers of the container of FIG. 1.
Figure 4:
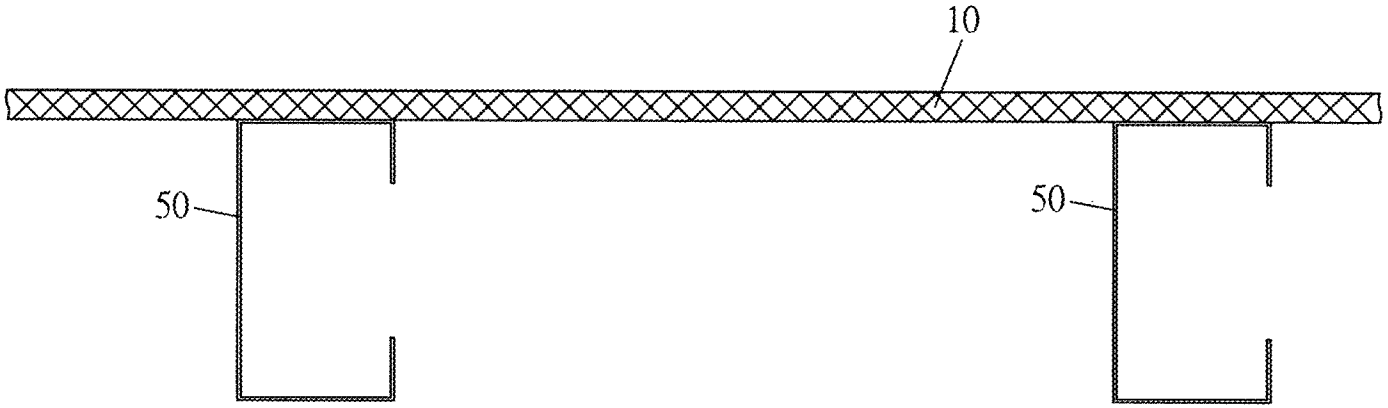
FIG. 4 is a sectional diagram showing a plate assembly and supporting steel bars of the container of FIG. 1.

As shown in FIG. 2, the container is equipped with at least one door panel 70. The structure of this door panel 70 is assembled from the inside in sequence, consisting of at least one plate assembly 10, with at least one reinforcing steel bar 20 placed at intervals. At least one heat-insulating fireproof layer 30 is filled between the reinforcing steel bars 20.

The reinforcing steel bars 20 are spaced at intervals of 60 cm.

The heat-insulating fireproof layer 30 can be made of heat-insulating fireproof rock wool.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A container with fire-resistant, explosion-withstanding, and heat-insulating capabilities, comprising:

a plurality of structural steel bars end-to-end connected as edges of a rectangular structure;

at least one composite fireproof and explosion-proof plate assembly comprising two coated and perforated steel plates and a reinforced fiberboard fixedly sandwiched in between;

at least two cross-sectionally square-shaped reinforcing steel bars positioned on an outer side of the at least one plate assembly whose two ends are respectively connected to two parallel structural steel bars on a side of the rectangular structure;

at least one external panel surrounded by the structural steel bars on a side of the rectangular structure;

at least one heat-insulating fireproof layer positioned between the at least two adjacent reinforcing steel bars, and between the at least one plate assembly and the at least one external panel; and at least one cross-sectionally C-shaped supporting steel bar, whose two ends are respectively connected two parallel structural steel bars on a bottom side of the rectangular structure, laid beneath the at least one plate assembly.

2. The container according to claim 1, wherein the coated and perforated steel plates of the at least one plate assembly are galvanized perforated steel plates.

3. The container according to claim 1, wherein at least one of the coated and perforated steel plates of the at least one plate assembly has sawtooth-shaped circular perforations.

4. The container according to claim 1, wherein the reinforced fiberboard of the at least one plate assembly is a reinforced fiber cement board.

5. The container according to claim 1, wherein the at least two reinforcing steel bars are spaced at an interval of 60 cm.

6. The container according to claim 1, wherein the at least one heat-insulating fireproof layer is made of heat-insulating fireproof rock wool.

7. The container according to claim 1, further comprising at least one door panel wherein the at least one door panel comprises at least one plate assembly, at least two reinforcing steel bar, and at least one heat-insulating fireproof layer filled between the at least two reinforcing steel bars, sequentially positioned from inside out.

8. The container according to claim 7, wherein, when the at least two reinforcing steel bars are spaced at an interval of 60 cm.

9. The container according to claim 7, wherein the at least one heat-insulating fireproof layer is made of heat-insulating fireproof rock wool.

* * * * *